United States Patent [19]

Green

[11] 4,258,366

[45] Mar. 24, 1981

[54] MULTIFREQUENCY BROADBAND POLARIZED HORN ANTENNA

[76] Inventor: Robert A. Frosch, Administrator of the National Aeronautics and Space Administration, with respect to an invention of Kenneth A. Green, N. Andover, Mass.

[21] Appl. No.: 8,209

[22] Filed: Jan. 31, 1979

[51] Int. Cl.[3] ..... H01Q 13/00

[52] U.S. Cl. ..... 343/786; 343/755; 343/772; 343/781 R

[58] Field of Search ..... 343/729, 755, 776, 781, 343/786, 854, 772

[56] References Cited

U.S. PATENT DOCUMENTS

| | | | |
|---|---|---|---|
| 3,369,197 | 2/1968 | Giger et al. | 343/786 |
| 3,568,204 | 3/1971 | Blaisdell | 343/786 |
| 3,754,273 | 7/1974 | Takeichi et al. | 343/786 |
| 3,936,838 | 2/1976 | Foldes | 343/786 |
| 3,949,404 | 4/1976 | Green | 343/761 |

OTHER PUBLICATIONS

Green, Kenneth, "Multifrequency, Broadband, Dual-Polarized Antenna", NASA Tech. Brief, Winter 1976, NPO 13866, p. 516.

Takeda et al., "Broadbanding of Corrugated Conical Horns", IEEE Trans. on Ant. and Prop., Nov. 1976, pp. 786–792.

Kumazawa et al., "Wide-Band Communication Satellite Antenna", IEEE Trans on Ant. and Prop., May 1975, pp. 404–407.

*Primary Examiner*—David K. Moore

*Attorney, Agent, or Firm*—Monte F. Mott; John R. Manning; Paul F. McCaul

[57] ABSTRACT

A multifrequency, broadband, dual-polarized corrugated conical horn antenna is simultaneously fed a multiplicity of signals, two for each of five frequencies, with each of a pair of signals fed in each of two orthogonal planes for excitation of a desired spherical hybrid mode ($HE_{11}$). The lowest frequency is fed into the horn through orthogonal pairs of colinear slots, each pair being fed by coaxial tee power dividers. Other signals are fed through a circular waveguide connected to the vertex. Band reject cavities block the next higher frequency from passing through the low frequency feed slots. The highest frequency signals are fed through orthogonal ports near the far end of the circular waveguide. The intermediate frequency signals are fed through orthogonal ports spaced along the waveguide. Filtering is incorporated for each to maintain isolation and low insertion loss, a quarterwave step transformer is used between the highest frequency (37 GHz) ports and the two next lower frequencies (21 GHz and 18 GHz) to provide a short circuit for these two lower frequencies, and a $TM_{11}$ mode generator for the highest frequency is used as a short circuit for the next lower frequency (10.69 Ghz).

4 Claims, 9 Drawing Figures

MULTIFREQUENCY BROADBAND POLARIZED HORN ANTENNA

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

This invention relates to a multifrequency, broadband, dual-polarized or circularly polarized horn antenna.

Many applications require a highly efficient, multifrequency dual-polarized scanning antenna system. Ideally, the system should have the same constant width, symmetrical beam for both polarizations and all frequencies, and should have very low side lobes at all frequencies. A horn-reflector antenna system in disclosed is U.S. Pat. No. 3,949,404 capable of producing a spherical aperture phase front using a hyperbolic reflector illuminated by a corrugated conical horn. The far-field beam produced has low sidelobes and high efficiency. This antenna system is insensitive to frequency and polarization changes, and would therefore be suitable for multifrequency dual-polarized scanning purposes, but the problem is simultaneously feeding the corrugated conical horn with more than one frequency when the frequencies are spaced over one or more octaves.

Dual-frequency horn antennas have been devised in the past for widely spaced frequencies. The higher frequency is fed at the vertex of the horn in the usual manner, and the lower frequencies are fed into the horn where the cross-sectional dimensions are greater. See for example Hirayuki Kumazawa, Masaki Kayama and Yashio Kataoka, "Wide-Band Communication Satellite Antenna Using a Multifrequency Primary Horn", IEEE Transactions on Antennas and Propagation, May 1975, pp. 404–407. A problem with this approach is the limited number of widely spaced frequencies which can be accommodated with good isolation of the frequency channels. Thus, while such a multi-frequency antenna system may be adequate for the particular application for which designed, it would not be able to produce as many as five or more concentric distinct beams with similar width; and high efficiency over a wide range (e.g., 6.6 to 37 GHz). Such a requirement would be, for example, a scanning multichannel microwave radiometer (SMMR) to be used on the Numbus G and Seasat A satellites.

The SMMR requires a highly efficient multifrequency antenna system to be achieved by using a corrugated conical horn (CCH) and scanning reflector with geometry similar to that disclosed in U.S. Pat. No. 3,949,404. The reflector is an offset paraboloid of 31-inch diameter projected aperture fabricated out of graphite-epoxy, and the feed subassembly is a dual polarized horn. The design of the horn is an extension of a previous multi-frequency ring loaded CCH reported in a National Aeronautics and Space Administration Tech Brief NPO 13866 published in "Winter 1976 NASA Tech Briefs" at page 516. The horn is a broadband, dual-polarized antenna. The ring-loaded CCH has been reported by Fumio Takeda and Tsutomu Hashimoto, "Broadbanding of Corrugated Conical Horns," IEEE Trans on Ant. & Prop., Nov. 1976, pp. 786–792. See also U.S. Pat. No. 3,754,273 granted to the authors as coinventors with Yoshihiro Takeichi. The problem of adapting a ring loaded CCH antenna as a feedhorn in an SMMR, or other application requiring a highly efficient, multifrequency dual polarized antenna, is to obtain operation on both polarizations at a multiplicity (typically 5) of frequencies over a wide range (typically from 6 to 37 GHz) to provide a multiplicity of signals (two for each frequency, one for each polarization) simultaneously, with low insertion loss and good isolation between frequencies and polarizations, as well as extremely low sidelobes and symmetrical nearly equal beamwidths for all polarizations and frequencies. It is that problem that is solved by this invention.

SUMMARY OF THE INVENTION

In accordance with the present invention, a multifrequency, broadband, dual-polarized corrugated conical horn is provided with longitudinal slots near the small diameter end of the cone, one pair in each of two orthogonal planes for excitation in a desired spherical hybrid mode ($HE_{11}$) at the lowest of the frequencies. Paired slots are fed by coax-to-waveguide adapters and each symmetrical pair is fed through a transmission line power divider, such as a coaxial tee power divider. Other higher frequencies feed through a circular waveguide connected to the small diameter end of the horn, with the highest frequency fed at the end of the waveguide farthest from the smallest diameter end, and intermediate frequencies at spaced points between the remote end of the waveguide and the of the small diameter end of the conical horn antenna. At each point, two orthogonal ports are provided for excitation of the desired orthogonal polarizations at the same frequencies. Each of the ports is fed through a waveguide which contains a low pass filter to reject frequencies above their own, and a quarterwave step transformer is provided between the highest frequency port at the end and the first pair of ports along the circular waveguide to provide a short circuit for the next one or more lower frequencies. Each intermediate frequency along the circular waveguide is thus isolated from signals of higher frequency by low pass filters. The ports in the side of the cone fed at the lowest frequency are isolated from the next higher frequency by a band reject cavity set for the next higher frequency. The circular waveguide is provided with sections of minimum diameter for propagation of the frequencies fed through the ports in the sections. A tapered $TM_{11}$ mode generator for the highest frequency is used as a short circuit for the next lower frequency.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
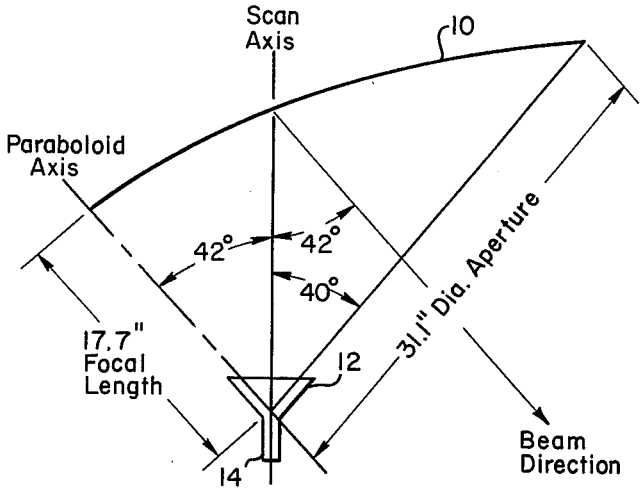
FIG. 1 is a schematic diagram illustrating the geometry of an exemplary antenna system utilizing a multifrequency corrugated conical horn (CCH) that is the subject of the present invention.

Referring now to the drawings, FIG. 1 shows the geometry of a highly efficient multifrequency antenna system comprised of an offset paraboloid reflector 10 fed by a corrugated conical horn (CCH) 12 with a multiplicity of frequencies. The reflector has a 31-inch diameter projected aperture and is fabricated of graphite-epoxy. The CCH is of a broadband, multimode ring-loaded design with ports on the side for excitation with one low frequency, and a circular waveguide 14 connected to the vertex (small diameter end) of the horn for excitation with higher frequencies as will be described more fully with reference to FIGS. 2 and 3.

Although reference is made to "excitation" or "feeding" of the antenna system, it should be noted that in this exemplary embodiment, the multifrequency antenna is designed for use a as multichannel microwave radiometer. As such the system is intended to receive rather than transmit, but as in all passive microwave systems, the performance is reciprocal. Therefore reference will be made to "feeding" the antenna system with a multiplicity of frequencies for convenience only, it being understood that the antenna system may as well receive the same frequencies simultaneously.

The dual-polarized frequencies fed are, for example, five frequencies from 6.6 GHz to 37 GHz. The system requires simultaneous operation on orthogonal polarizations at 6.633, 10.69, 18, 21 and 37 GHz with low insertion loss and near optimum illumination on all 10 channels. As just noted above, both polarizations of the lowest of the five frequencies are coupled into the CCH via ports on the side of the cone while both polarizations of the highest frequency are fed in at the end of the waveguide which functions as a multiplexer for coupling both polarizations of four widely spaced frequencies into the vertex of the cone. The primary patterns achieved yield highly efficient secondary patterns of all 10 signals simultaneously, two (dual polarized) signals at each frequency. As will be pointed out with reference to FIG. 2, good isolation between frequencies and polarizations is maintained.

The reflector 10 is designed as a section of a paraboloid to subtend an angle of $40°+42°=82°$, with edge illumination of approximately $-18$ dB. The scan axis for the particular and exemplary application of the antenna system is perpendicular to Earth's surface and the beam follows a circular arc of $\pm 25°$ on the Earth's surface, as the reflector scans about the vertical axis. The CCH (12) and the feed waveguide 14 are stationary at the focal point (the vertex of the horn 12) with its axis coincident with the horn axis and the scan axis.

Figure 2:
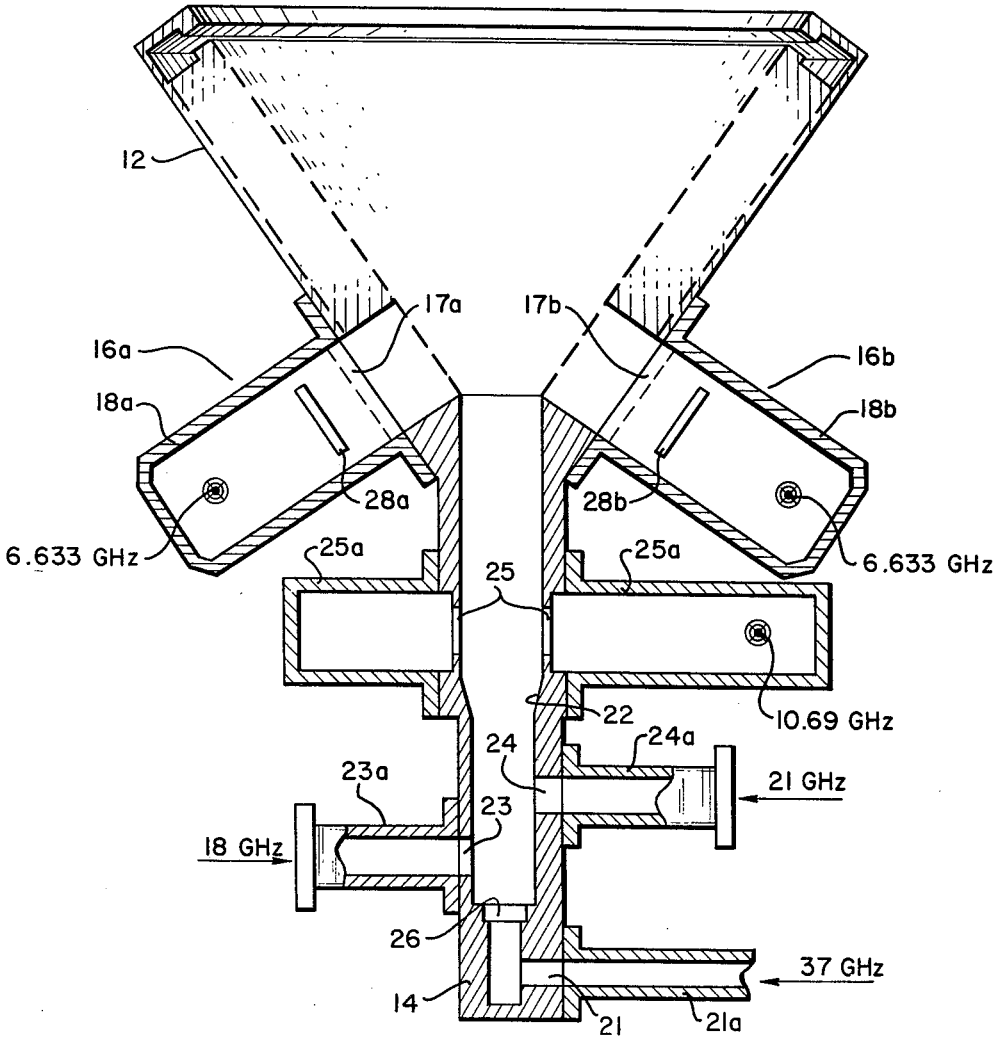
FIG. 2 is a cross section of the multifrequency corrugated conical horn of FIG. 1.

Referring now to FIG. 2, it shows all of the ports in a single cross section of the assembly necessary for five colinear frequencies of one polarization. A similar structure in an orthogonal plane excites all of the ports necessary for the five co-linear frequencies of a polarization orthogonal to the one polarization. Consequently, it should be clearly understood that FIG. 2 illustrates the 10-port feed for the horn 12 which operates with dual polarization at each of five frequencies simultaneously in a 6:1 band. In that manner, orthogonally polarized spherical hybrid modes ($HE_{11}$) are excited in the corrugated conical horn 12 at 6.633, 10.69, 18, 21 and 37 GHz. This yields primary illumination patterns with low sidelobes and approximately equal E and H plane beamwidths for all frequencies and polarizations.

Figure 3A:
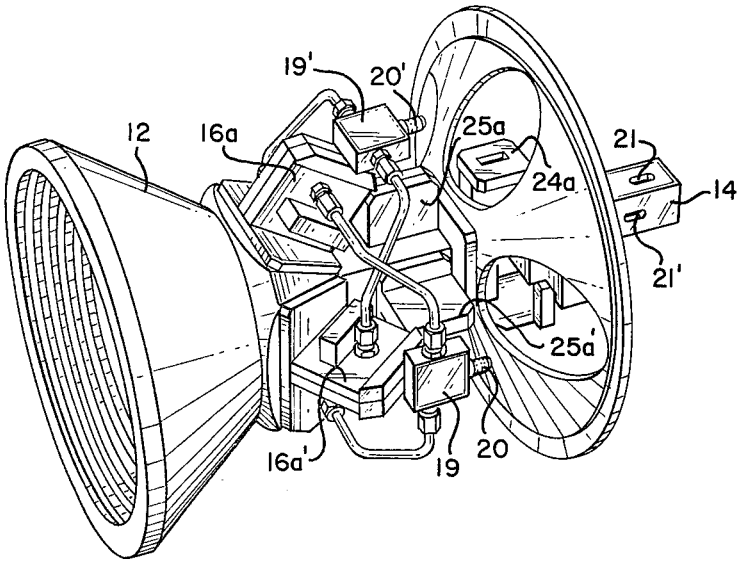
FIGS. 3*a* and 3*b* are front and rear perspective views of the corrugated conical horn of FIG. 1.
Figure 3B:
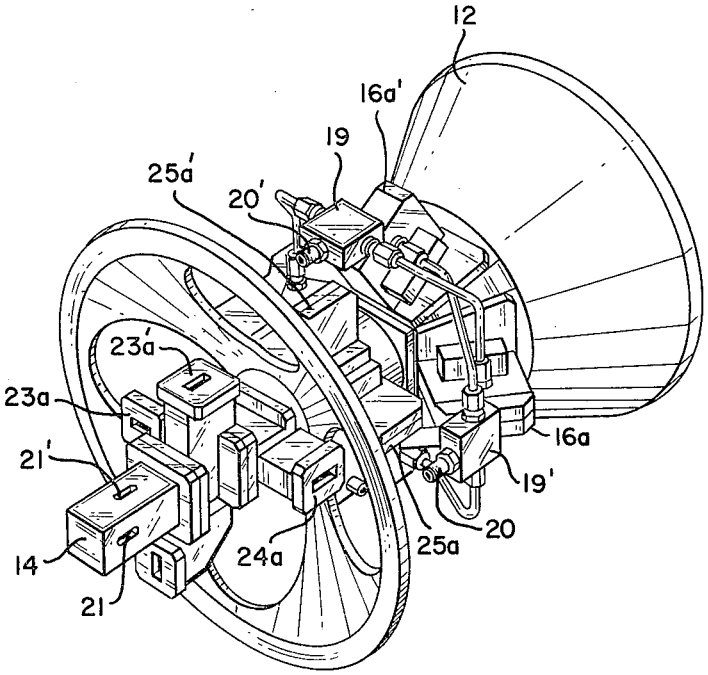
Figure 4:
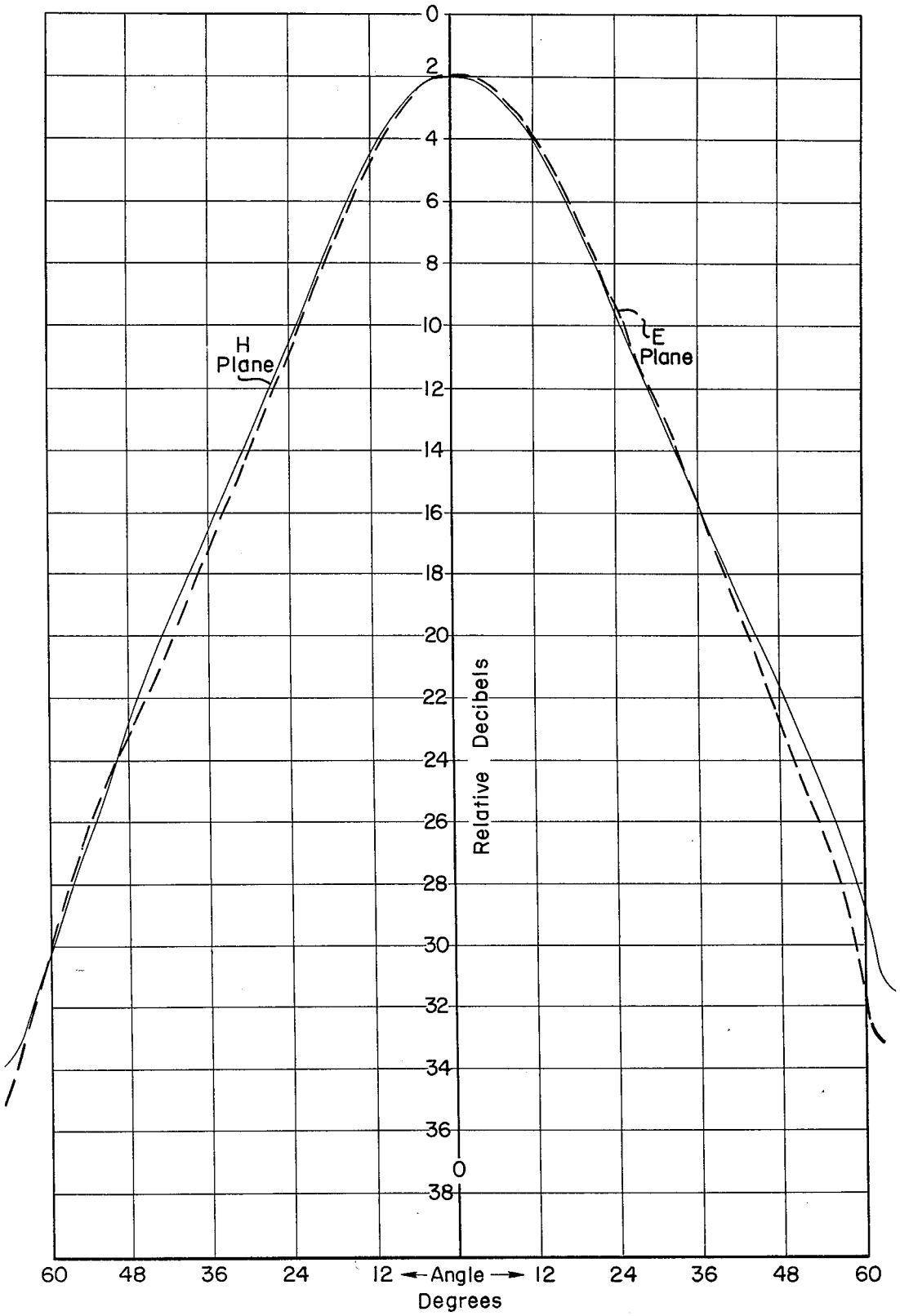
FIGS. 4, 5, 6, 7 and 8 illustrate the E and H plane beam patterns which are typical of each polarization at each of the different frequencies fed into the CCH of FIG. 1.
Figure 5:
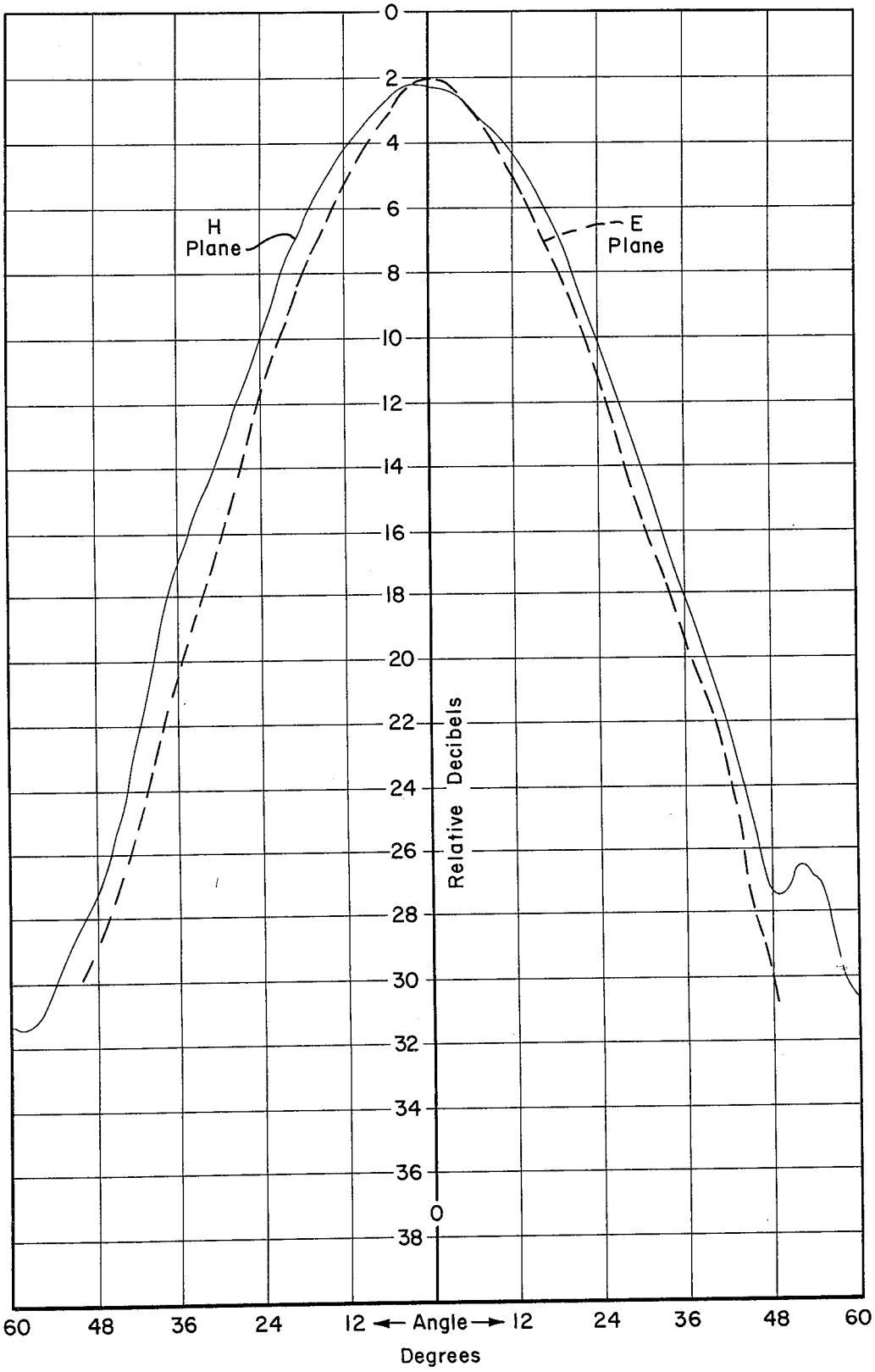
Figure 6:
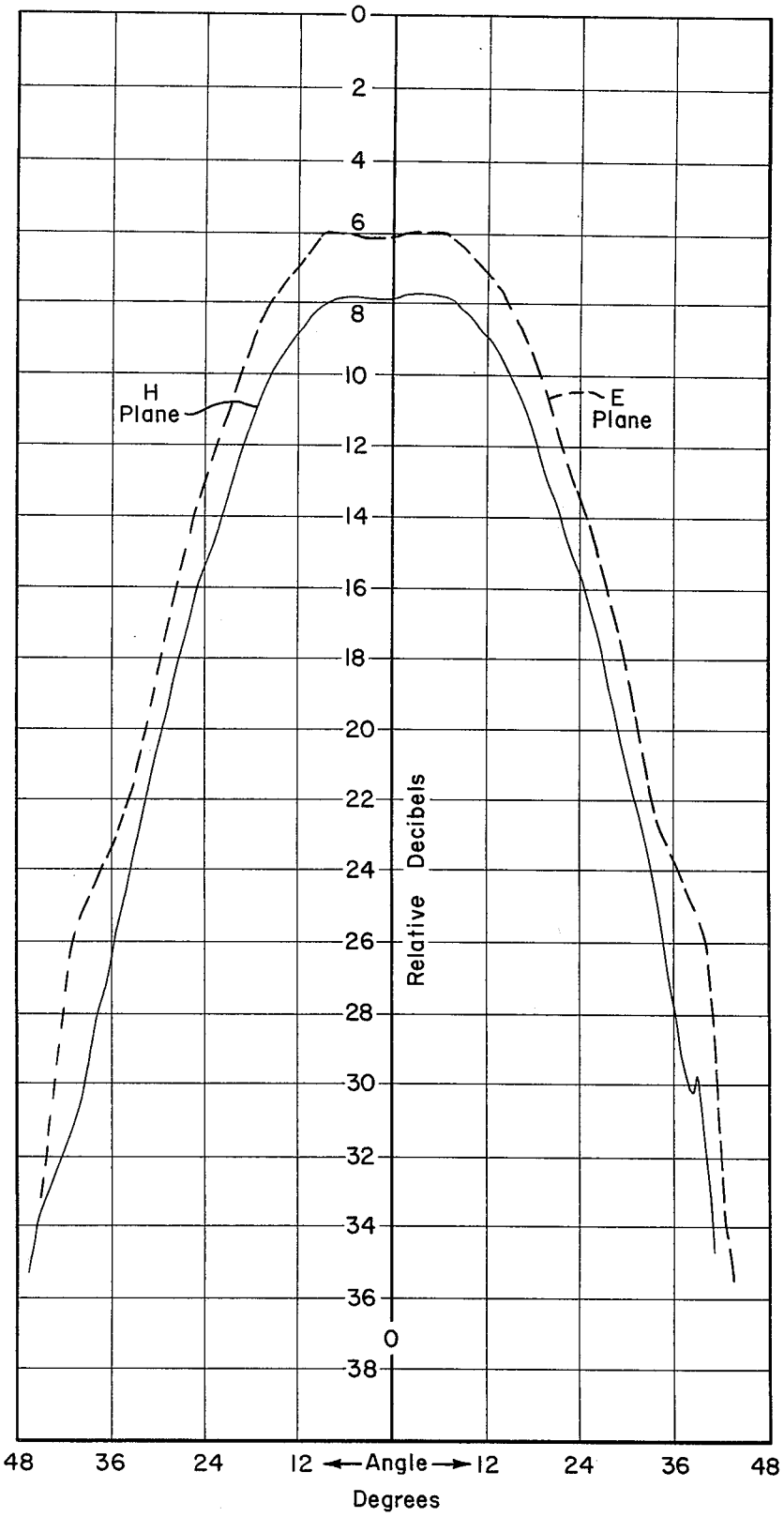
Figure 7:
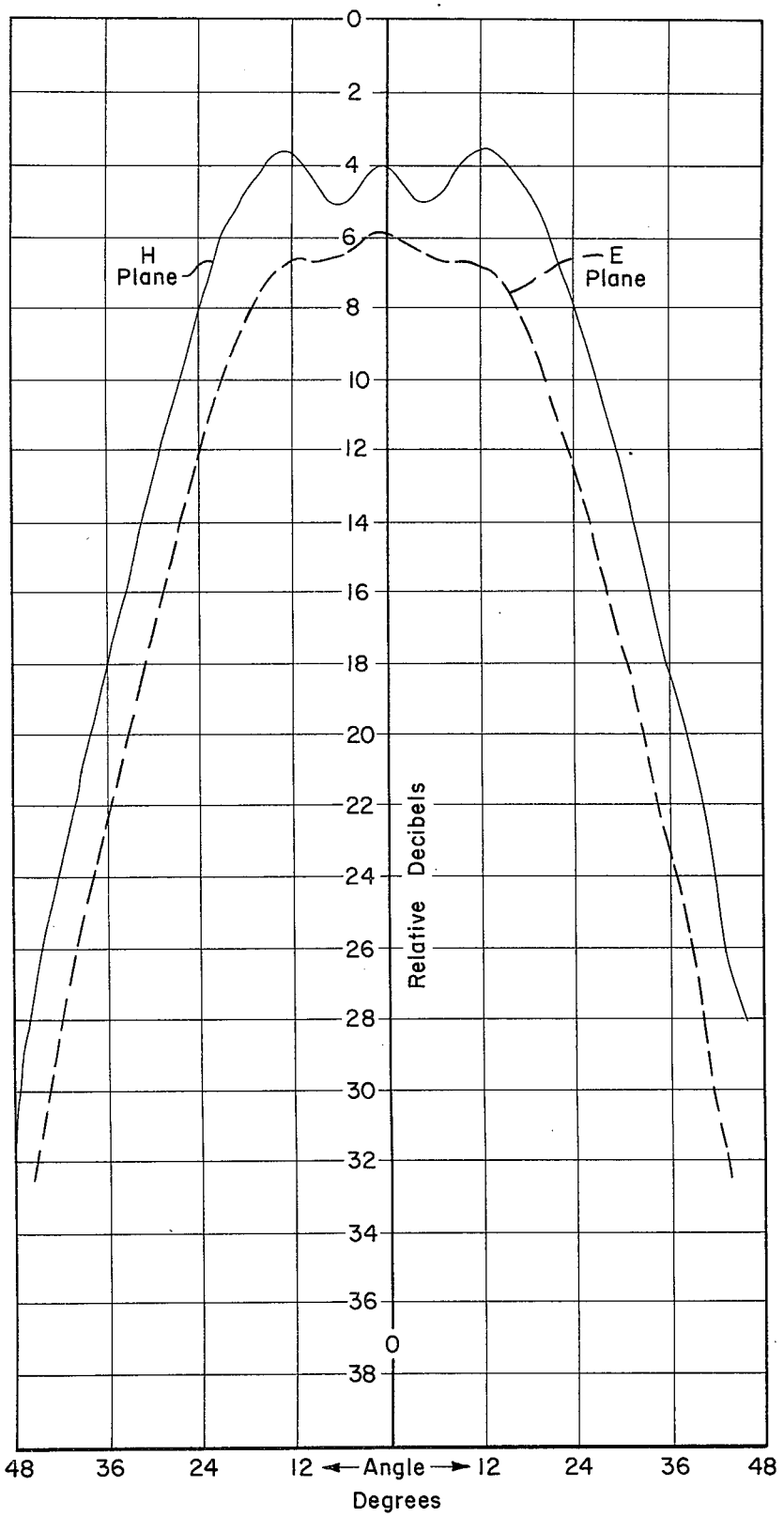
Figure 8:
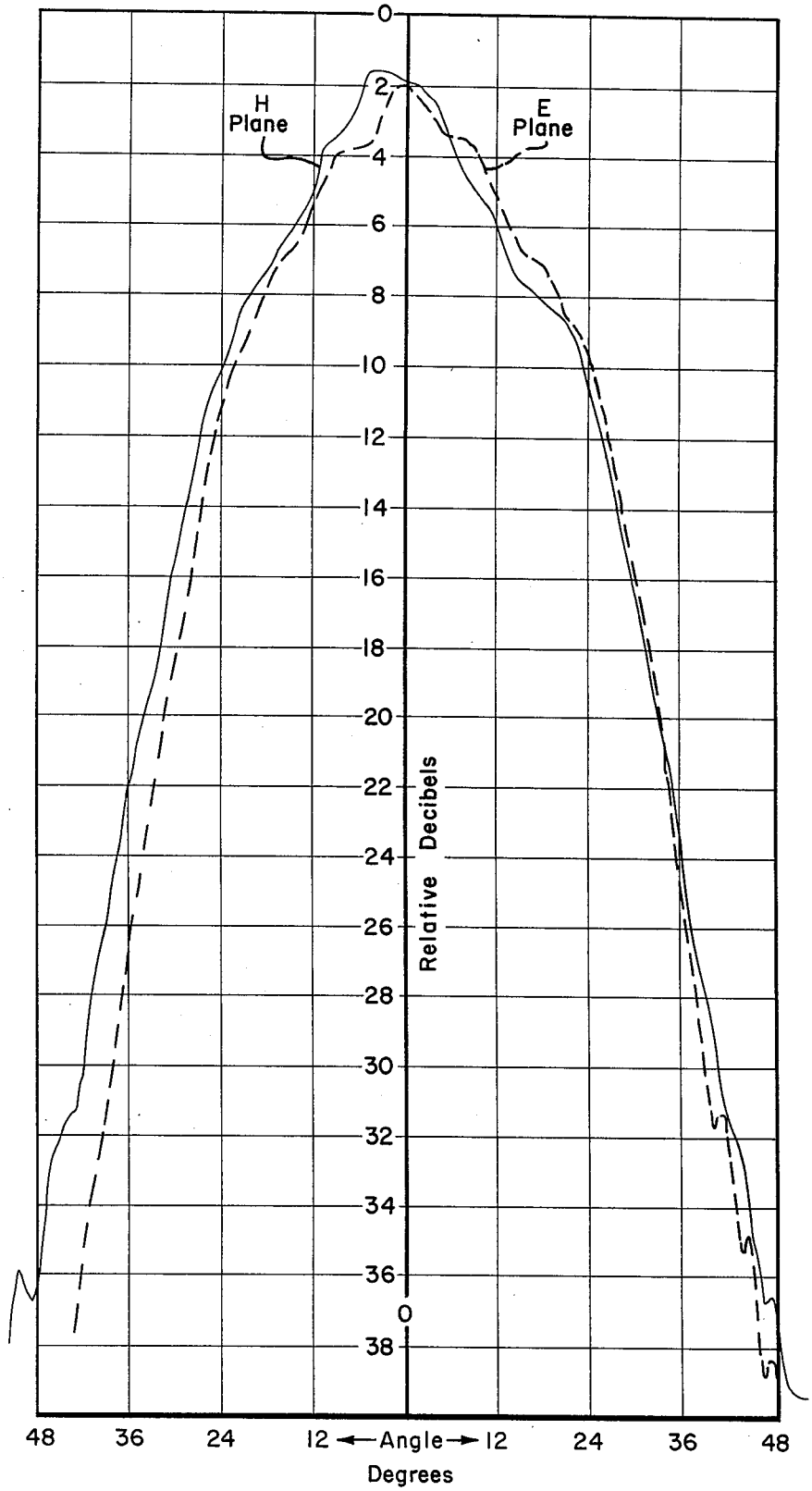

The $HE_{11}$ spherical hybrid mode for the lowest frequency is excited into the corrugated conical horn through side ports $\mathbf{16}_a$ and $\mathbf{16}_b$ provided in the form of a pair of longitudinal slots $\mathbf{17}_a$ and $\mathbf{17}_b$ near the vertex of the cone. Each slot is backed by a coax-to-waveguide adapter, 18*a* and 18*b*, and each symmetrical pair is fed a colinear signal in phase through a coaxial tee power divider 19 (FIG. 3*a*). This arrangement yields symmetry in each plane, for suppression of undesirable higher order modes, and excellent isolation between orthogonal polarizations. The coax-to-waveguide adapters and coaxial tee power divider for the orthogonal polarization are identified in FIGS. 3*a* and 3*b* by the reference numerals 16*a*′, and 19′. The two coaxial connectors (one for each polarization) are identified by the reference numerals 20 and 20′.

The desirable features of a corrugated horn are: equal E and H plane beamwidths; low sidelobes; coincident E and H plane phase center of radiation; near-constant beamwidth and phase center over a broad band. These features are obtained if a sufficient length of capacitive surface inside the horn is produced by the corrugations. Fundamentally, each annular groove is a short circuited stub which will produce a capacitive surface effect when electrically equal to or greater than a quarter wave and less than a half wave deep. (This is also true between $\frac{3}{4}$ of a wave and one wavelength, etc.) The effective bandwidth in the fundamental range then appears to be limited to less than an octave, as in a rectangular waveguide. However, use of impedance steps (ridges or rings) can increase the bandwidth to greater than 3:1, just as is done in ridged waveguides. By proper choice of groove configuration and spacing, it is possible to obtain capacitive surface impedance inside the horn at all five frequencies needed over the 6:1 band. It should be noted that many other groups of frequencies could be utilized over even greater bandwidths, although the entire band may not be usable simultaneously, and some unique combinations may not be obtainable. The inoperative (inductive) frequency regions may be reduced or eliminated by tapering the corrugation size along the horn, or interlacing different sizes.

The remaining four dual-polarized frequencies, 10.69, 18, 21 and 37 GHz, are fed through the circular waveguide 14 into the apex of the horn 12. The selected diameter and symmetry of the circular waveguide for propagation of 10.69 inhibits the propagation of higher order modes until about 21 GHz. To avoid undesired modes at 37 GHz, the dual polarized signals introduced at that frequency through ports 21 and 21′ at the end of the waveguide 14 must be concentrically fed through a step transformer 26. Further a $TM_{11}$ mode is generated in a region 22 in the waveguide 14 where its diameter changes, and this mode is phased with the $TE_{11}$ mode to produce a cosine tapered E field at the end of the circular waveguide (vertex of the conical horn). This means that the end of the waveguide becomes a low sidelobe radiating aperture at a point in the large conical horn which is the phase center of the spherical $HE_{11}$ modes of the other frequencies. It can be seen that the size of this aperture determines the beamwidth at this frequency, while the flare angle of the horn is the controlling parameter at all other frequencies. These must be compatible, but the waveguide size is also limited by the other frequencies it must propagate. This thus presents limitations on the choice of frequencies which may be more severe than the limits of the corrugations. Of course, a quad-ridged circular or square waveguide would increase the bandwidth, potential but would also introduce other moding considerations described by Chen and Tsandoulas in "Modes of Quadruple Ridged Waveguides," IEEE Transactions on MTT Aug. 1974, p.801.

The 8-ports coupling into the circular waveguide 14 is termed an "orthomode multiplexer." It is comprised of the 8-port assembly of orthomode transducers and filters used as a low loss combiner for both polarizations of four frequencies into the circular waveguide. FIG. 2 shows how colinear polarizations are combined. 37 GHz enters at the end and fed past the 18 GHz, 21 GHz and 10.69 GHz ports 23, 24 and 25, which contain respective low pass, waffle-iron type filters 23*a*, 24*a* and 25*a* to reject frequencies above their own. The quarter-wave step transformer 26 between 37 GHz and 18 GHz ports is a short circuit for 18 GHz and 21 GHz, and the 37 GHz $TM_{11}$ mode generator 22 is the short circuit for 10.69 GHz. The 37 GHz port needs no filter as it is the highest frequency and its waveguide 21*a* is a high-pass filter. This concept is used at all ports to isolate substantially lower frequencies. However, the low pass filter 23*a* in the 18 GHz port does not isolate 21 GHz, as this is not a large enough frequency separation for a low pass application. Other type filters could be used (e.g. band-pass or band-reject) but the lowest insertion loss technique that could be used was found to be positioning the 18 GHz port between the 21 GHz port and its short circuit 26, at a null of the 21 GHz standing wave.

It should be noted that to isolate widely separated frequencies could require rejection of several modes, and that a short circuit at the coupling aperture is necessary to avoid exciting modes in the common waveguide. A waffle-iron filter rejects all modes, and produces a short at a common reference plane. The presence of the ring loaded corrugations in the CCH effectively isolates 18 GHz, 21 GHz and 37 GHz from the 6.633 GHz ports, but additional isolation at 10.69 GHz (fundamental mode only) is provided by a single band reject cavity in each waveguide identified by the reference numeral 28*a* and 28*b* in FIG. 2. In that manner, insertion loss is low and good isolation between frequencies and dual polarizations is maintained for five separate frequencies with high efficiency and constant beam width for all frequencies as shown by FIGS. 4, 5, 6, 7 and 8 which compare the beam patterns for the dual polarizations at the different frequencies. For each frequency side lobes for each polarization are very low and the beamwidth is symmetrical for both polarizations.

The primary E and H plane radiation patterns at all five frequencies have thus been demonstrated to be very nearly the same. Cross polarization level is less than about −20 dB in each case. The E and H plane symmetry is excellent at each frequency. The −10 dB beamwidth is 50° minimum and 60° maximum. (A constant −10 dB width within the space available was a design goal.) A longer horn would improve the frequency independency. Also, changes in the 10.69 GHz coupling ports would improve the cross polarization, and hence, isolation, at that frequency. A design goal of constant −3 dB widths could be used for purposes other than illuminating a secondary aperture, but the results would not be as good due to the ripple on the peak of the beams at 21 and 37 GHz. At 21 GHz the ripple is due to higher order HE modes generated at the horn and circular waveguide junction. At 37 GHz the ripples are caused by the CCH perturbing the dual mode aperture pattern.

Extensive secondary patterns of the horn feeding an offset paraboloid have been recorded on the five antenna subsytems built. Identical, excellent results were obtained. In all cases the far-field beamwidths and sidelobes measured agreed with the values to be expected of an optimum focused horn with the same primary pattern. This is evidence that the phase centers of radiation for all ten beams are within a fraction of wavelength of each other.

In summary a unique, complex and highly successful antenna system has been disclosed particularly suited for satellite-borne radiometers. However, the multifrequency, dual polarization performance could also have wide application in radar and communication systems because of its excellent characteristics. Specifically, it has a constant beamwidth, high efficiency and dual polarization for operation over an octave band, or at several frequencies spaced over several octaves. This is achieved through the combination of a ridged corrugated horn, coupling apertures through the corrugations, a dual mode aperture at the horn vertex, and a dual polarized (orthomode) multiplexer feeding through the dual mode aperture. The multiplexer employs lowpass filters, orthomode transducers and a unique spacing of ports at one frequency to obtain isolation without resonant elements.

Although particular embodiments of the invention have been described and illustrated herein, it is recognized that modifications and variations may readily occur to those skilled in the art. For example, the pair of ports at any frequency can be simultaneously fed by an equal power divider such that the relative phase at the ports is 90°, and circular polarization of the beam results. Such polarization flexibility for any or all frequencies may be useful in some applications. As a further example, feeding a pair of orthogonal ports at a frequency with relative phase at the ports of 0°, and varying the amplitude sinusoidally such that the modulation is 90° out of phase, rotating linear polarization of the beam results.

I claim:

1. A multifrequency, broadband horn antenna comprising a ring loaded corrugated conical horn having a large diameter end and a small diameter end, said small diameter end having a common axis with said large diameter end and said conical horn being open at the large diameter end thereof, and having at least one diametrically opposed pair of ports at a position near the small diameter end for feeding a colinear signal of low frequency, and a multiplexer for simultaneously feeding additional colinear frequency signals spaced over multiple octaves into said conical horn through said small diameter end, said multiplexer comprising a waveguide having a plurality of ports, and means for fixing standing waves of signals fed into said waveguide, at least one port for each additional colinear frequency signal, said ports being spaced along said waveguide with the port for the highest frequency signal at the end furthest from said small diameter end, and the ports for the intermediate frequency signals spaced between the end of the waveguide and the small diameter end, each intermediate colinear signal port having connected thereto a low pass filter to reject frequencies above the frequency fed into the port through the filter, and at least one port for a lower frequency than the highest being at a position corresponding to the standing wave null of a higher frequency for isolation from signals of the higher frequency.

2. The combination of claim 1 wherein said multiplexer has a first section next to the small diameter end of said conical horn for propagation of the highest frequency fed into said multiplexer through orthogonal ports at the end of the section remote from the small diameter end of said conical horn.

3. The combination of claim 2 wherein said waveguide has a second section of a diameter suitable for propagation of at least one higher frequency fed into said multiplexer through orthogonal ports in the second section, said second section being connected to the first section by a $TM_{11}$ mode generator for the highest frequency being fed through orthogonal ports at the ends of a third section of said waveguide of a diameter suitable for propagation of said highest frequency, said third section being connected to said second section by a quarter wave step transformer to provide a short circuit for each frequency fed into said second section, thereby to prevent lower frequency signals from propagating into said third section.

4. The combination of claim 3 wherein two frequencies are fed into said section with a frequency separation between the two frequencies not large enough for the low pass filter of the ports of the frequency of the lower of the two frequencies to isolate the other of the two frequencies, said ports for said lower of the two frequencies being between the ports of the higher of the two frequencies and said quarter wave step transformer and being located at a null of the standing wave of the higher of the two frequencies.

* * * * *